US006334631B1

(12) United States Patent
Hollander

(10) Patent No.: US 6,334,631 B1
(45) Date of Patent: Jan. 1, 2002

(54) ENTERTAINMENT AND EDUCATION PACK

(75) Inventor: Milton Bernard Hollander, Stamford, CT (US)

(73) Assignee: Omega Engineering, Inc., Stamford, CT (US)

( * ) Notice: Subject to any disclaimer, the term of this patent is extended or adjusted under 35 U.S.C. 154(b) by 0 days.

(21) Appl. No.: 09/361,123

(22) Filed: Jul. 27, 1999

Related U.S. Application Data

(63) Continuation-in-part of application No. 09/097,657, filed on Jun. 16, 1998, which is a division of application No. 08/740,604, filed on Oct. 31, 1996, now Pat. No. 5,890,741, and a division of application No. 09/263,458, filed on Mar. 5, 1999.

(51) Int. Cl.[7] ..... G09F 15/00; B42D 19/00; B42D 1/00

(52) U.S. Cl. ..... 283/56; 281/2; 281/5; 283/62; 40/124.12

(58) Field of Search ..... 434/81; 273/296, 273/299, 300, 302, 307, 308; 283/2, 51, 52, 50, 52.1, 62; 281/15.1, 38, 2, 5; 40/124.01, 124.09, 124.11, 124.12

(56) References Cited

U.S. PATENT DOCUMENTS 4,010,964 A * 3/1977 Schechter ..... 283/56
4,157,842 A * 6/1979 Silver ..... 281/38
4,589,590 A * 5/1986 McGuire ..... 229/92.8
4,658,125 A * 4/1987 Kachi ..... 235/449
4,711,454 A * 12/1987 Small ..... 273/269
4,757,624 A * 7/1988 Holec ..... 40/119
4,850,611 A * 7/1989 Skelton ..... 281/5
5,098,131 A * 3/1992 Tucker ..... 283/105
5,466,010 A * 11/1995 Spooner ..... 283/67
5,547,225 A * 8/1996 DeAngelis ..... 281/21.1

* cited by examiner

*Primary Examiner*—Jacob K. Ackun, Jr.
*Assistant Examiner*—K. Fernstrom
(74) *Attorney, Agent, or Firm*—William A. Drucker

(57) ABSTRACT

A booklet for disseminating advertising and technical information has a number of pages secured in a bundle between front and back covers, the pages being secured to a binding formed between the front and back covers, the pages being individually releasable as a whole from the binding, or being weakened across their height dimension adjacent to the binding, so as to permit a major portion of the page to be separated leaving a stub secured to the binding, the pages being elongated and having on their front and back surfaces cartoon-displaying areas and material of an advertising technical nature, the cartoon-displaying areas being individually separable from the remainder of the page. The front cover, at least, may also include cartoon-displaying and advertising technical material.

The bundle of pages may have cartoon-displaying material and advertising technical material arranged as to be presented alternately through the bundle.

1 Claim, 8 Drawing Sheets

FIG. 1
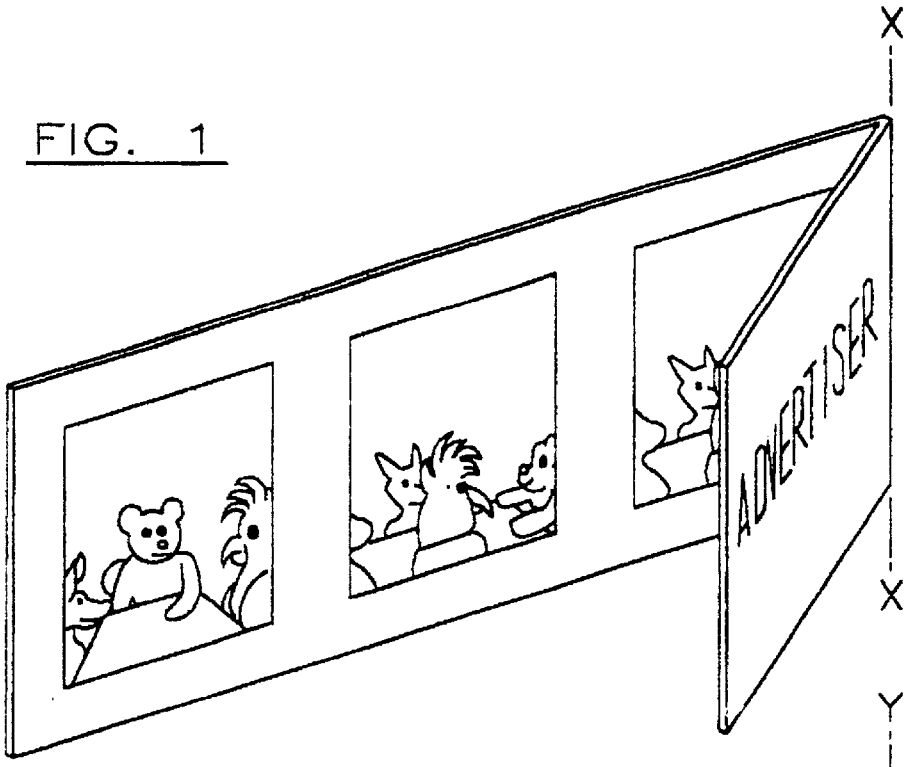
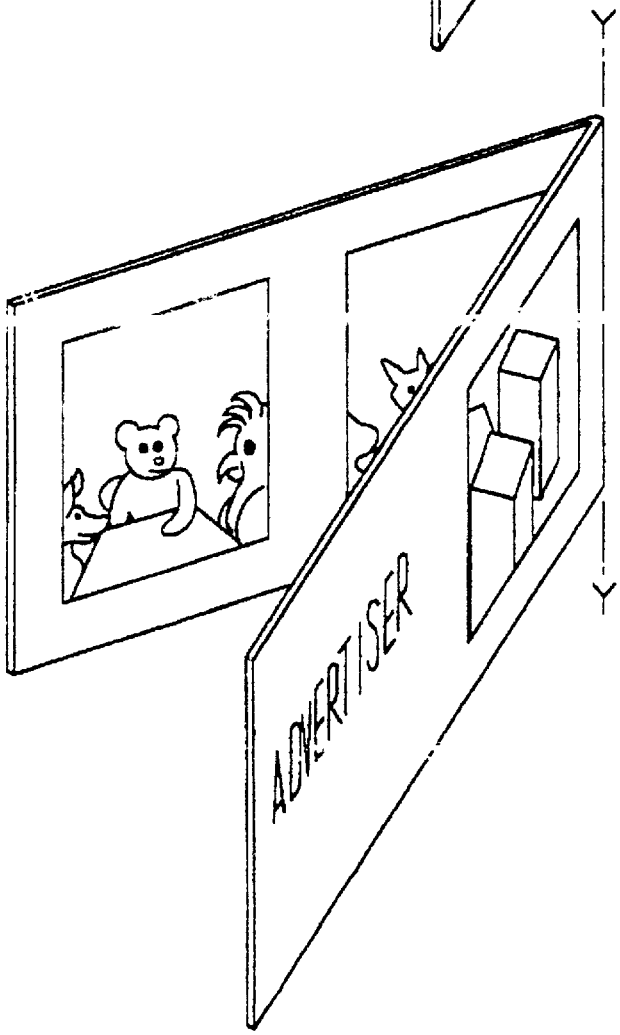
FIG. 2

ENTERTAINMENT AND EDUCATION PACK

SPECIFICATION

This is a continuation-in part of my co-pending U.S. patent applications Ser. No. 09/097,657 filed Jun. 16$^{th}$ 1998, which is a division of Application No. 08/740,604 filed Oct. 31$^{st}$ 1996, now U.S. Pat. No. 5,890,741 issued Apr. 6, 1999; and my Pending application Ser. No. 09/263,458 filed Mar. 5$^{th}$ 1999.

BACKGROUND OF THE INVENTION

Field of the Invention

The invention relates generally to displays of an entertainment and educational nature, and specifically in a first form to sheets which can be readily varied, as by folding and unfolding action, so as to present selectively an entertainment aspect and an educational aspect at the will of the user, whereas in a second form the invention relates generally to promotional, advertising, cataloging and like material, and more particularly to such material which has incorporated in it graphic and/or verbal content adapted to arouse and sustain the interest of a recipient.

OBJECTS OF THE INVENTION

An object of the invention is to permit a display, for example of comparable dimensions to a known playing card, or a known postal card, to have a dual purpose of being both adapted to have an entertainment aspect, e.g. to permit use in playing a card or other game, or to permit the forming of collections of popular subjects, or a serial display such as a cartoon strip, and also adapted to have an educational aspect, e.g. to permit display of useful information such as commercial information, or educational facts or formulae. Game rules or a score card may be on one surface.

Another object is to provide an article of manufacture in stackable form suitable for postal distribution.

A further object is to provide a device arranged to permit tear off parts to be separated by a user for mailing or games or collecting.

A still further object is to provide a method of manufacturing such displays.

A still further object of the invention is to provide an advertising item comprising a plurality of sheets which are bound in a pack and which can be readily separated from the pack, as a whole or by leaving a stub in the pack, such sheets bearing on a first face attention catching material such as one or a series of cartoons, and on a second face advertising and/or technical material.

Yet another object of the present invention to provide a promotional display structure which displays both promotional material and also "interest sustaining" material, as described in detail herein, for the purpose of seeking to maintain the promotional material within the field of view and attention of the recipient.

It is another object of the invention to provide such a promotional display structure which can be readily manufactured in a bulk form and which permits individual portions of display structure to be readily separated for use.

It is another object of the invention to provide such a display structure, which is adapted, in its whole, or part form, to be sent through the mails.

It is a still further object of the invention to provide a promotional display structure, which has a series of related panels showing "cartoon" type illustrations, with or without accompanying verbal material.

It is a still further object of the invention to provide methods of construction and assembly, and of dis-assembly, of the display structure.

SUMMARY OF THE INVENTION

According to a first aspect of the invention there is provided a rectangular card which comprises a sheet of material having a portion with a hinge action defining in the sheet, preferably along the shorter dimension, a plurality of plane leaves, the hinge and leaves being such that when adjacent leaves are folded about the hinge they become superposed in corresponding position. One face of each leaf, when the card is fully folded, bearing representational matter of entertainment value to a user, and the other face of each leaf, when the card is fully folded, bearing representational matter which is of educational value to the user.

According to a second aspect of the invention there is provided a method of forming a promotional display structure which comprises steps of:

(1) Providing elongate strips of bendable sheet material to form pages;

(2) Providing on a first face of each such strip textual display including promotional matter;

(3) Providing on a second face of each such strip illustrative cartoon matter;

(4) Assembling a plurality of said strips, each having a different display in a pack with their respective first and second faces alternating in the pack;

(5) Connecting said plurality of strips at one end of their elongation to retain them in the form of the said pack, said connection being such as to permit strips to be detached by hand from the remainder of the pack;

According to a further aspect of the invention, a promotional display structure comprises a plurality of elongate strips of bendable sheet material constituting pages, each such strip having on a first face textual display including promotional matter, each such strip having on a second face illustrative cartoon matter, different from other strips, said strips being assembled in a pack and being connected at one end of their elongation to retain them in the form of said pack, the connection being such as to permit strips to be detached by hand from the remainder of the pack.

According to a further aspect of the invention there is provided a booklet comprising a plurality of flexible sheets which are bound between covers of a stiffer material to form a pack, said sheets being removable individually from the remainder of the pack, said sheets bearing on a first face material serving to catch and hold the attention of a viewer and on a second face material of an advertising and/or technical nature. Said sheets in a first embodiment are made removable by separating them as an entity from the remainder of the pack, e.g as by loosening them from the binding, and in a second embodiment are made removable by being weakened along a line across their height dimension, as by perforation, to permit the main part of the sheet to be torn off manually and leaving a stub thereof in the remainder of the pack.

BRIEF DESCRIPTION OF THE DRAWINGS

The above-mentioned and other further objects, features and advantages of this invention will be made apparent to those having skill in this art, by the following specification considered with reference to the accompanying drawings, in which:

FIG. 1 shows the two faces of an elongate card folded at a transverse line X—X:

FIG. 2 shows the two faces of an elongate card folded at a transverse line Y—Y:

DETAILED DESCRIPTION OF THE INVENTION

Referring to FIG. 1 there are shown the two faces of an elongate card which is adapted to be folded about a transverse line X—X. One face of the card has entertainment material, represented say by the cartoon figures shown. The other face of the card has educational or instructive material, represented for example by pictures of items of electronic apparatus, to which suitable explanatory wording would be added in practice, and details of an advertiser. When the card is in fully folded condition, the two leaves, at each side of the fold line X—X, are superposed. Preferably, the card when folded, or at least one leaf, has dimensions, which correspond to, for example, a standard playing card, or to a mailable postcard. This is an elongated rectangular shape.

FIG. 2 shows a similar card in which the transverse fold line Y—Y is central along the length of the card, the two faces having similar subject matter as in FIG. 1.

Figure 3:
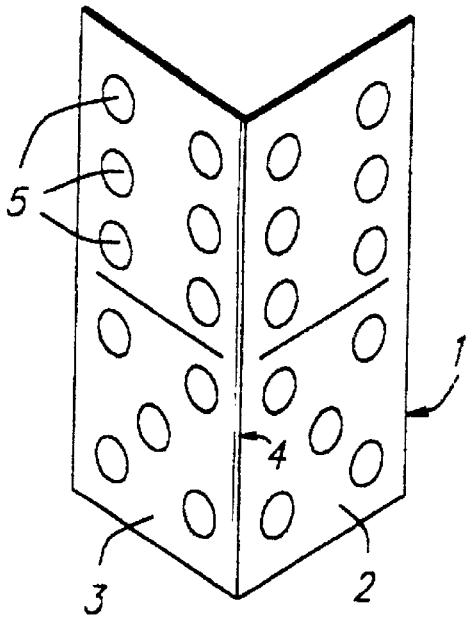
FIG. 3 is a perspective elevation of a single-fold card to show external surfaces bearing subject matter.
Figure 4:
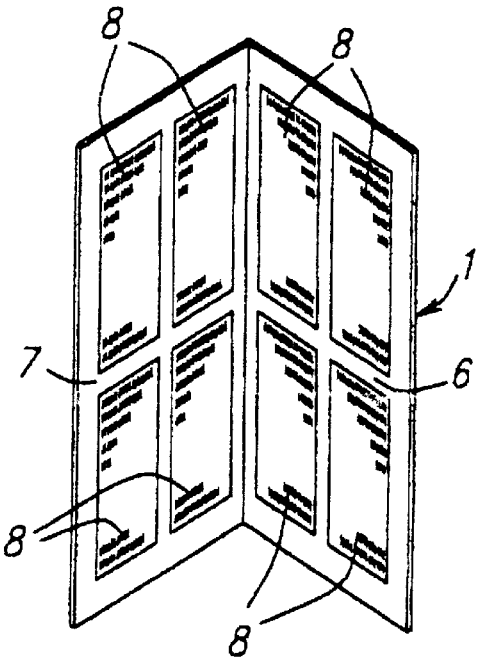
FIG. 4 is a perspective elevation of the foldable card of FIG. 3 to show internal surfaces bearing subject matter.

Referring now more specifically to FIGS. 3 and 4 of the drawing there is shown a single-fold card designated generally by reference numeral 1. The card 1 has two leaves, 2 and 3 meeting at a hinge line 4, at least one of the leaves 2 and 3 being of standard mailable postcard dimensions.

The card 1 may be made of any suitable sheet material, which is adequately stiff but foldable at the hinge line 4, and may be a single sheet or a laminated sheet. Parts may be separable by tearing at the hinge, or at other locations, for remailing or game playing.

On the outer face of each leaf 2 and 3 there are provided markings 5 suitable for permitting the cards to be used in, for example, playing a game, or a strip cartoon, or to form a collection of useful knowledge such as pictures of football players, or 'flags of all nations', or coats-of-arms, or any other kind of subject matter which can be readily be formed into a series which is of interest. In the example illustrated, which is purely by way of illustration, the card has one of the conventional pairs of sets of 'spots', which appear on the playing pieces of the game of dominoes. It is envisaged that there would be provided, in a pack referred to later therein, a sufficient number of the cards to enable a game to be played or a set of interesting features acquired.

Referring now to FIG. 4, there is seen the same card as FIG. 3, but with the faces 6 and 7 revealed, these faces being those which become internal faces when the card is fully folded. On the faces 6 and 7, there is provided other subject matter contained in a plurality of printed panels 8 and it will be seen that when the card is in the fully folded state the printed panels 8 will all be on the 'inside of the card'. The panels 8 bear educational and/or informative material, such as for example, items of history or geography, or details of new commercial products, or technical advances in any scientific art. Where a game is on the outer face, the rules may be on an inner face, and/or a score sheet may be provided.

It will be seen that, when the individual cards of an entire set of such cards are all in the fully folded condition, the cards can be used to play a game or reveal a cartoon strip, or show football teams or display collections of educational items, as the case may be.

Figure 5:
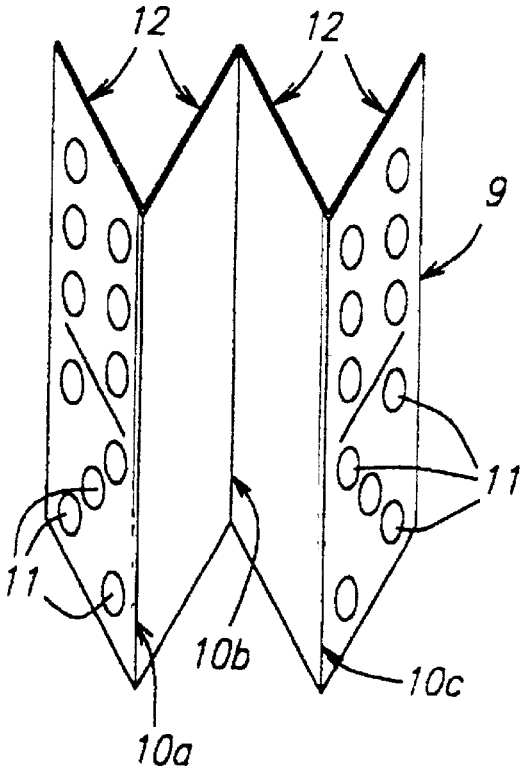
FIG. 5 is a perspective elevation of a multiple-fold card to show external surfaces bearing subject matter.

Referring now to FIG. 5 there is shown a perspective elevation of a second form of foldable card 9 in which there are provided three folds 10*a*, 10*b*, 10*c*, which result in the formation of four identical 'outer' faces 11. It will be apparent, without the need for illustration, that the card will likewise have a total of four 'inner' faces similar to the face of 6 of FIGS. 3 and 4. On those 'outer' faces 11, which appear when the card is fully folded, there are marked the indications such as those, referred to in the description of FIGS. 3 and 4. e.g. the 'spots' of a representative playing piece of a game of dominoes. The material marked on such outer faces may be any as referred to herein with reference to FIG. 3 and 4.

On each of the four correspondingly formed 'inner' faces 12, which are not visible in this Figure of the drawing, but which would correspond to the 'inner' faces 6 and 7 of FIGS. 3 and 4, there are provided similar panels of educational and/or informative material.

It is to be noted that, whereas in FIGS. 1 and 2 the entertainment subject matter is on inner faces of the cards, in FIGS. 3, 4 and 5 the entertainment subject matter is on outer faces of the cards.

A set of a plurality of such cards 9, when all of the cards are in fully folded condition, can be used to play a game or any of the other functions described above with reference to FIG. 3 and 4.

Figure 6:
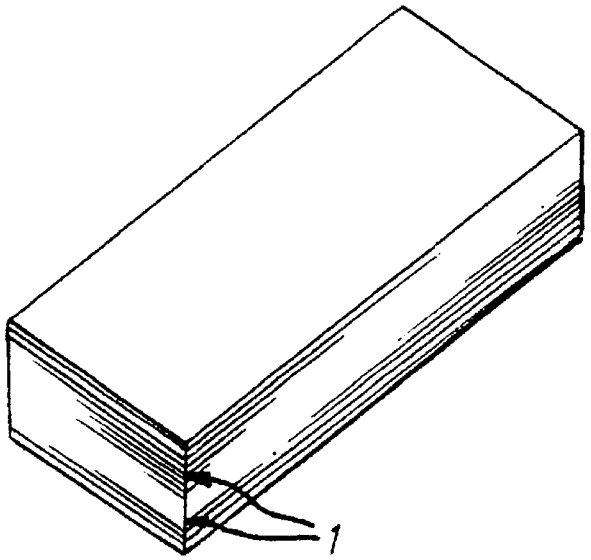
FIG. 6 is a perspective elevation of a mailable pack of any of the foldable cards of this invention, with the respective cards all being in fully folded condition in the pack.

Referring now to FIG. 6, there is seen a plurality of the cards of FIGS. 1 to 5, arranged as a pack which can be handled in the same manner as a conventional pack of playing or postal cards. Thus in accordance with this invention, there is further provided a pack of cards having a dual function of providing a readily accessible store of 'interest' material which can be used to play a game, form a collection or the like, and also another readily accessible store of educational and/or informative material, particularly for commercial purposes.

Figure 7:
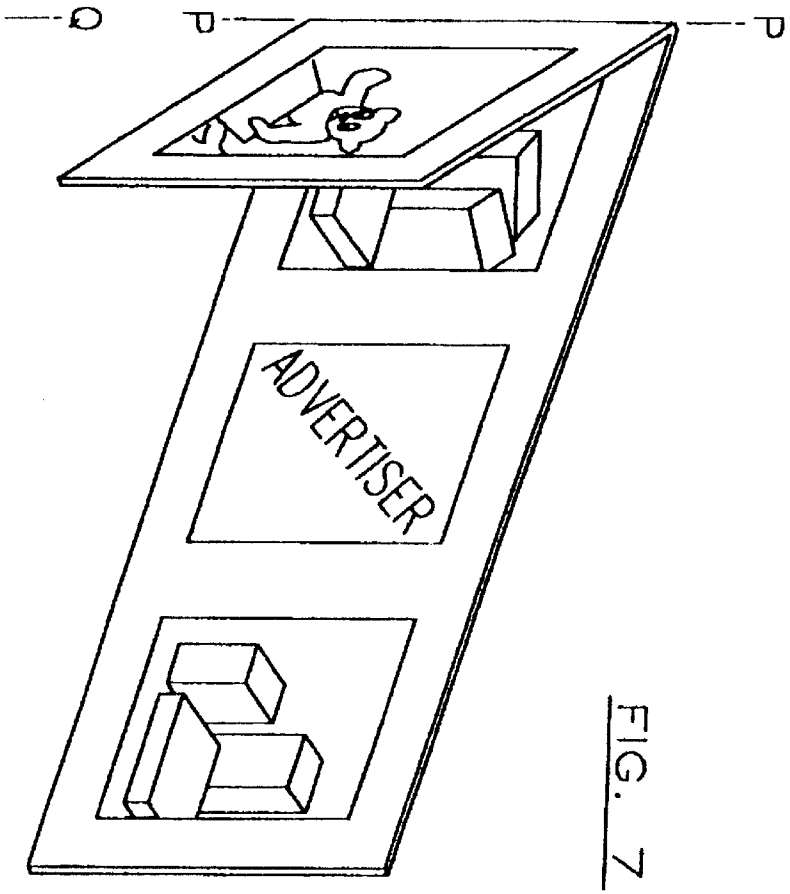
FIG. 7 shows the two faces of an elongate card folded at a transverse line P—P.

Referring now to FIG. 7 there is seen an elongate card which is folded about a transverse fold line P—P, but wherein the entertainment material, represented say by the cartoon figures shown, is on the outer faces of the folded card i.e. also on the rear face of the longer portion of the card, not visible in this Figure. On the inner face of the two leaves of the card there is provided educational, instructive and/or commercial material, as seen on the longer leaf, and this material would appear also on the inner face of the shorter leaf, but is not visible in this drawing.

Figure 8:
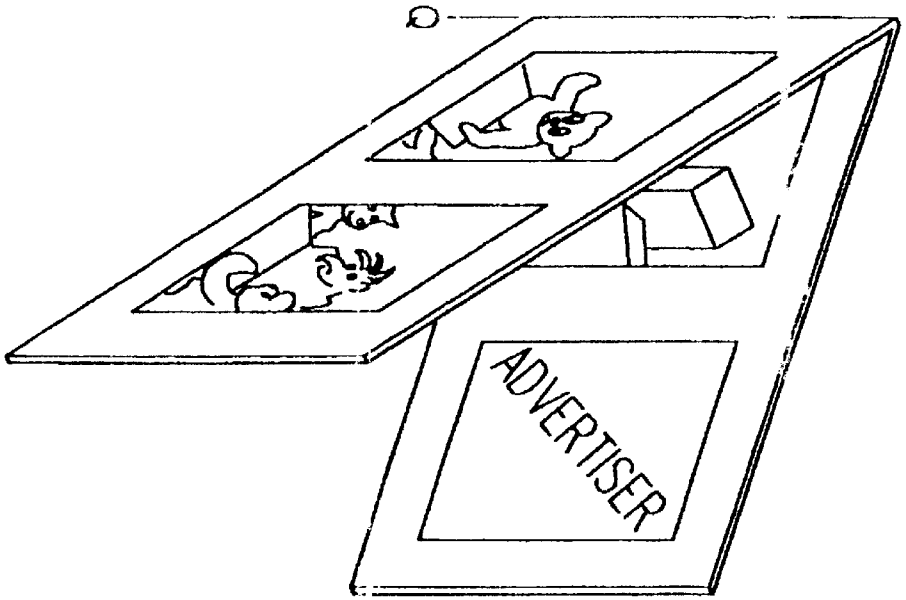
FIG. 8 shows the two faces of an elongate card folded at a transverse line Q—Q.

Referring to FIG. 8, there is seen an elongate card which is folded about a transverse fold line Q—Q, but wherein the entertainment material is similarly on the outer faces of the folded card, whereas on the inner faces there is similarly provided educational, instructive and/or commercial material.

It is to be noted that the cards of FIGS. 1 and 2 and 7 and 8, have their fold transverse to the longer dimension of card, whereas the cards of FIGS. 3, 4 and 5, have their fold along the longer dimension.

Although not limited to such dimensions, it is advantageous if the size of the longest part of the card, when fully folded, is that of a mailable postcard such that the pack of FIG. 6 would be a mailable pack.

The educational and/or informative material has been shown in the drawings as distributed in a number of panels on a face of the card, but, clearly it may be arranged in any convenient disposition on the face.

It will be apparent that the number of panels could be, for example, from three to eight, and a preferred number of panels is three.

The user may tear off one leaf, to be used for example in a game, and put the other leaf in the mail as a postcard. The pack of cards would usually, but not necessarily, consist of a plurality of cards all or some of which are different from the others.

In the drawings there have been shown cards with a single fold, and with three folds.

There could, for example, be provided without limitation thereto a number of folds like the single fold as illustrated in FIGS. 3 and 4. The fold line may be central or offset from the center to provide a short arm and also to provide a long arm of postcard size. The card may be supplied unfolded but with a pre-fold or scored tear line.

The use of the term 'plane' to describe the sheet material does not preclude the use of embossing, addition of one or more overlying portions of material, or perforation, or any combination of these functions.

The term "fold" used herein may include a perforation or scored or impressed line.

Figure 9:
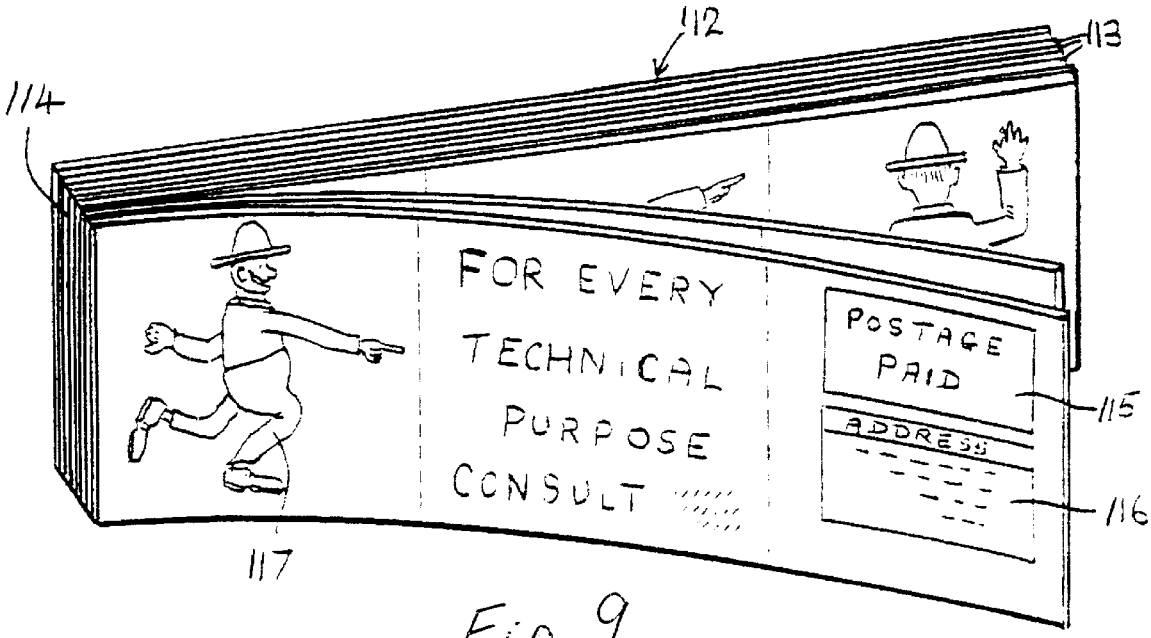
FIG. 9 is a perspective view of an embodiment of the invention having a number of sheets of relatively stiff material which are bound at one edge to provide a book-like appearance.
Figure 10:
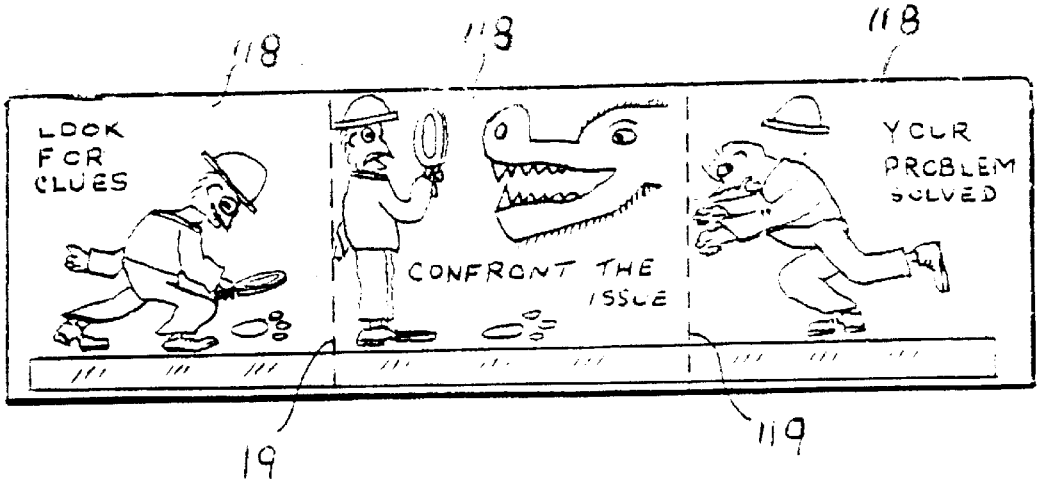
FIG. 10 is a plan view of the reverse face of a representative one of the sheets of the structure shown in FIG. 9.

Referring to FIGS. 9 and 10 of the drawings there is shown an embodiment wherein a book-like structure 112 comprises a relatively large number, say 50 or 100, sheets 113 bound at one end in any convenient manner, say as by gumming as shown at 114. Two of the sheets 113 are shown bent somewhat outwardly more readily to disclose the nature of the "pack" of sheets. On the front of each of such sheet 113, as seen in FIG. 9, there is various printed material such as a postal stamp area 115, a postal address area 116, and a representative cartoon FIG. 117 which gives an indication of the nature of the other cartoon subject matter to be found on the inside of the sheets of the book. The individual sheets 113 are made of a relatively stiff but bendable, or even foldable, card or heavy paper material. Each sheet 113 of the pack of sheets has, on its "inner" face, as seen in FIG. 10, a plurality of areas 118, which contain drawings, and/or textual material of a cartoon subject matter. Each of the sheets 113 has, on its reverse face, a different type of such cartoon material, or further examples of a single type. The cartoon material of each such sheet would be complete in itself, e.g. an illustrated story line. Further, at a base or other edge position on the reverse face there is provided additional information, such as for example how to contact the purveyor of the book of sheets and any other commercial information desirable. Although reference has been made above to only a single edge as being bound, in another embodiment more then one edge is bound, as by adhesive or in any other manner, which permits relatively easy, bending away and removal of the individual sheets. Each of the sheets 113 is in a further embodiment provided with one or more lines 119 indicating a point at which the sheet may conveniently be bent up, e.g. folded back on itself, and in a further embodiment such lines 119 are weakened, e.g. perforated to facilitate bending.

Figure 11:
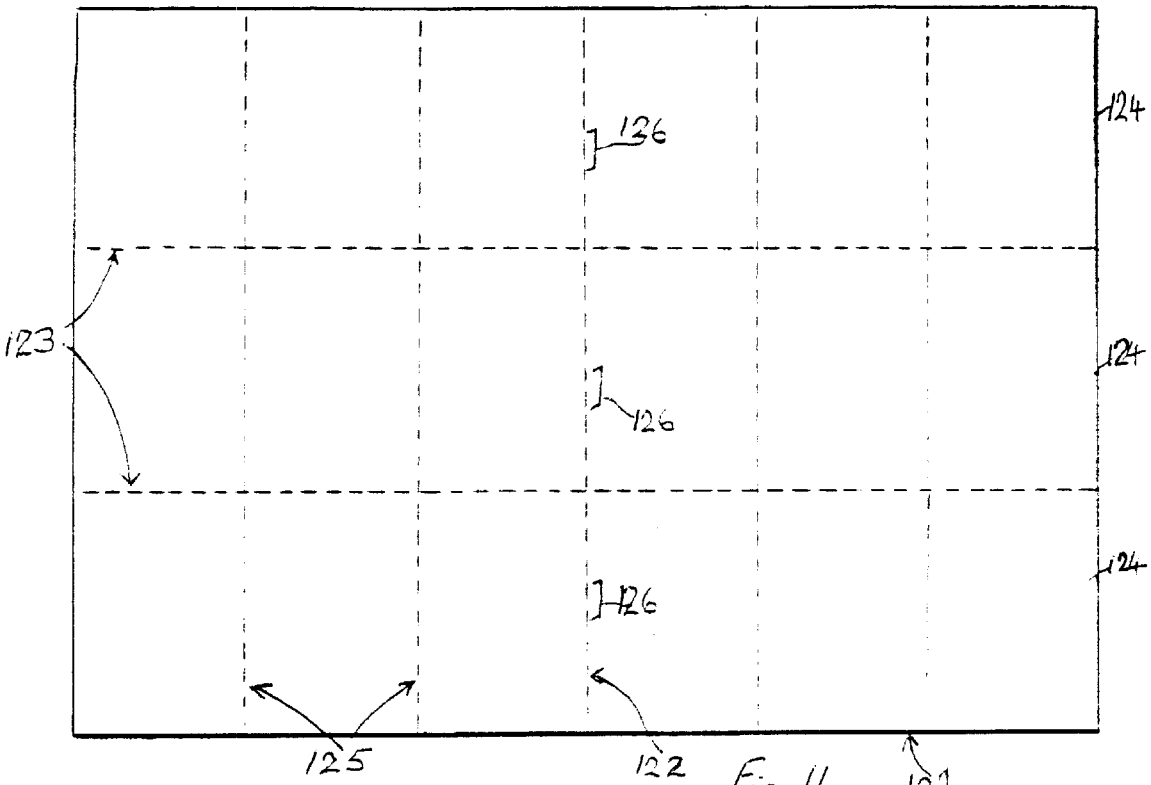
FIG. 11 is a plan view of a second embodiment having a sheet of card material as seen in a first stage of preparation of a plurality of the display structures of the invention.
Figure 12:
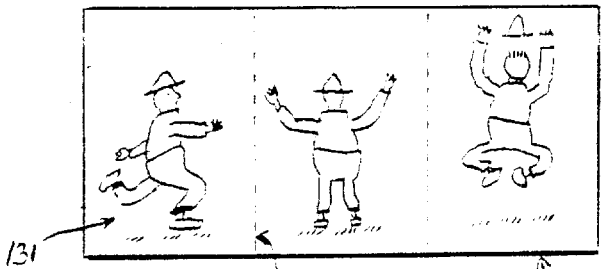
FIG. 12 is a plan view of a single portion of the card material of the embodiment of FIG. 11 in the course of folding it into the completed display structure.

Referring to FIG. 11 of the drawing a sheet 121 is made of a suitably stiff card or heavy paper material which in one embodiment is in a single piece, or in another embodiment is in two portions gummed or otherwise releasably connected, e.g. as by tape or other binding, at a vertical center line 122. In a preferred form, the center line 122 has a line of perforations, or weakenings, and the sheet 121 as a whole can be folded once about that line to provide a more manageable sheet size, e.g. for storage purposes. The sheet 121 is also perforated, or otherwise weakened, along two horizontal lines l23, so as to define in the sheet 121 a set of three horizontal strips 124. In another embodiment, the sheet 121 is cut, as by scissors for example, along the lines 123. The sheet 121 is further perforated, or otherwise weakened, along a plurality of vertical lines 125, for a purpose which is explained later herein.

If it is desired to provide the sheet 121 as a multi-layer sheet, or again if it is desired to connect two or more of the sheets 121 temporarily together, e.g. for storage, handling, or mailing purposes, then in a further embodiment the center line 122 has staples 126 or other fastening means thereon. Where on sheet 121, or a plurality of sheets 121, are folded about the center line 122, a form analogous to a book results.

The drawing shows the sheet 121 as being divided into a set of three strips 124, but it will be appreciated that, in other embodiments, a number greater than three could be used.

The face of the sheet 121 visible in FIG. 11 has, on each horizontal strip 124, a series of illustrations with or without accompanying wording and other graphic material which may be termed "cartoon" illustrations. By way of example, in a further embodiment there are provided three or more episodes of a cartoon character such as the well-known DILBERT. Each set of graphic material of a strip 124, is unique and complete in itself.

Figure 13:
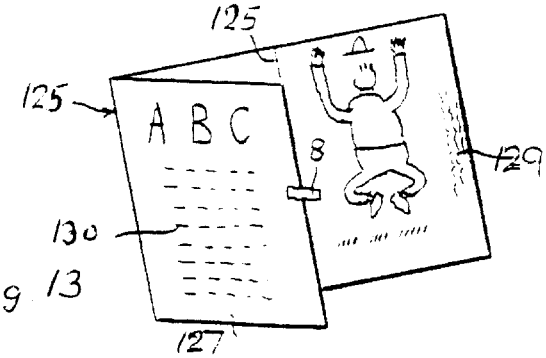
FIG. 13 is a perspective view of the display structure of the embodiment of FIG. 11 in the course of folding it into its substantially flat final form.

On the observe side of the sheet 121 there is printed or otherwise provided some advertising and/or technical and/or catalogue type promotional material. Referring to FIG. 13, one end portion 127 of the strip 124 has been folded forwardly, about a line 125, so that when the portion 127 is pressed flat against the rest of the strip 124, the advertising or other material is displayed to view.

In a further embodiment, provision is made to retain to the end portion 127 in the flat position, e.g. for storage, for handling, or mailing purposes, and for example a small tongue 128 readily releasable adhesive paper or the like is provided at one edge.

As the individual strips 124 are each of a relatively stiff material, the strips lend themselves to being pinned upon a notice board or advertising hoarding or other show mounting.

It is known that the U.S. Post Office will accept for mailing a single-fold card item, as shown in FIG. 13, and accordingly in another embodiment a mailing address 129 is printed or embossed at a free edge of the strip 124.

A distributor wishing to utilise the invention for the purposes of publicity and promotion of his goods, and at the same time to ensure that there will be a continued interest maintained in the promotional material, provides the promotional material 130 (FIG. 13) on the one face, and cartoon 131 or other "interest" material on the other face. As a result the cartoon or other interest material will tend to be noted and retained, e.g. by pinning it up on a notice board, so that at the same time the promotional material is kept in the field of view of staff or customers.

A user of the invention would keep a stock of the sheets 121, as seen in FIG. 11, in flat or folded condition, and at the same time of distribution, e.g. by mailing, would tear or cut off the strips 134.

Figure 14:
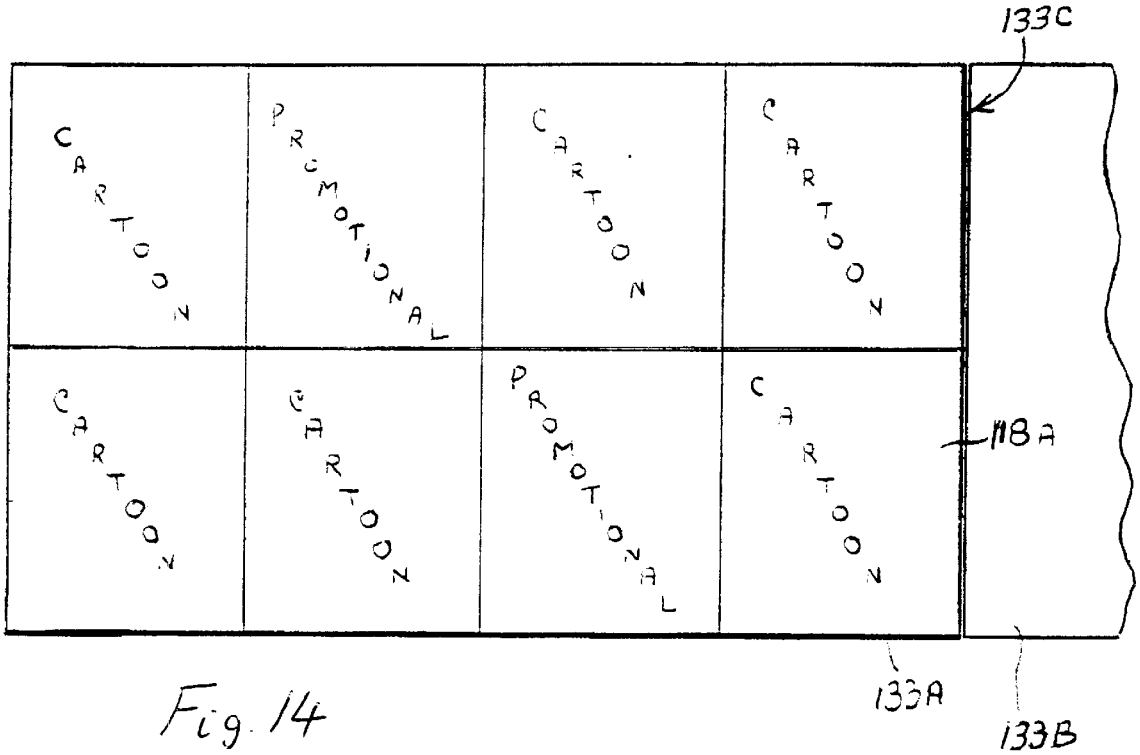
FIG. 14 is an elevation of the reverse face of a representative sheet of doubled vertical dimension.

Referring now to FIG. 14 of the drawing, there are shown the faces of two representative sheets 133A, 133B, hinged at 133C, of twice the vertical dimension so that the reverse or rear face of sheet 133A provides a total of eight areas 118A in which would be placed items of cartoon material in some areas and promotional material in other areas, and the upper and lower rows of areas could have different arrangements of the different types of areas, as shown.

In all of the cases described above, in a further embodiment the sheets are provided each with one of a series of cartoon pictures which, when the book is "riffled", give an illusion of movement of the cartoon characters.

The invention further provides a method of forming the promotional display structure including steps of:

(i) providing elongated strips of a relatively stiff but bendable sheet material to constitute pages;

(ii) providing on a first face of each such strip textual display including at least promotional material;

(iii) providing on the second face of each such strip at least some illustrative material of the nature of a cartoon;

(iv) connecting a plurality of said strips, in a readily releasable manner, at one edge of the elongation, to form a multi-page booklet from which individual pages can be removed by hand without disturbing the remainder.

The invention further provides a method, of disassembly of a promotional display structure having a plurality of elongated strips of a relatively stiff but bendable sheet material constituting pages, said strips being connected in readily releasable manner at one edge of the their elongation, said method including a step of removing individual strips one by one from said display structure.

The invention further provides an additional step, after removal of each strip, of folding back, on the remainder of the strip, of an end portion of the strip. In a further step, said folded back end portion is fastened releasably to the remainder of the strip.

Figure 15:
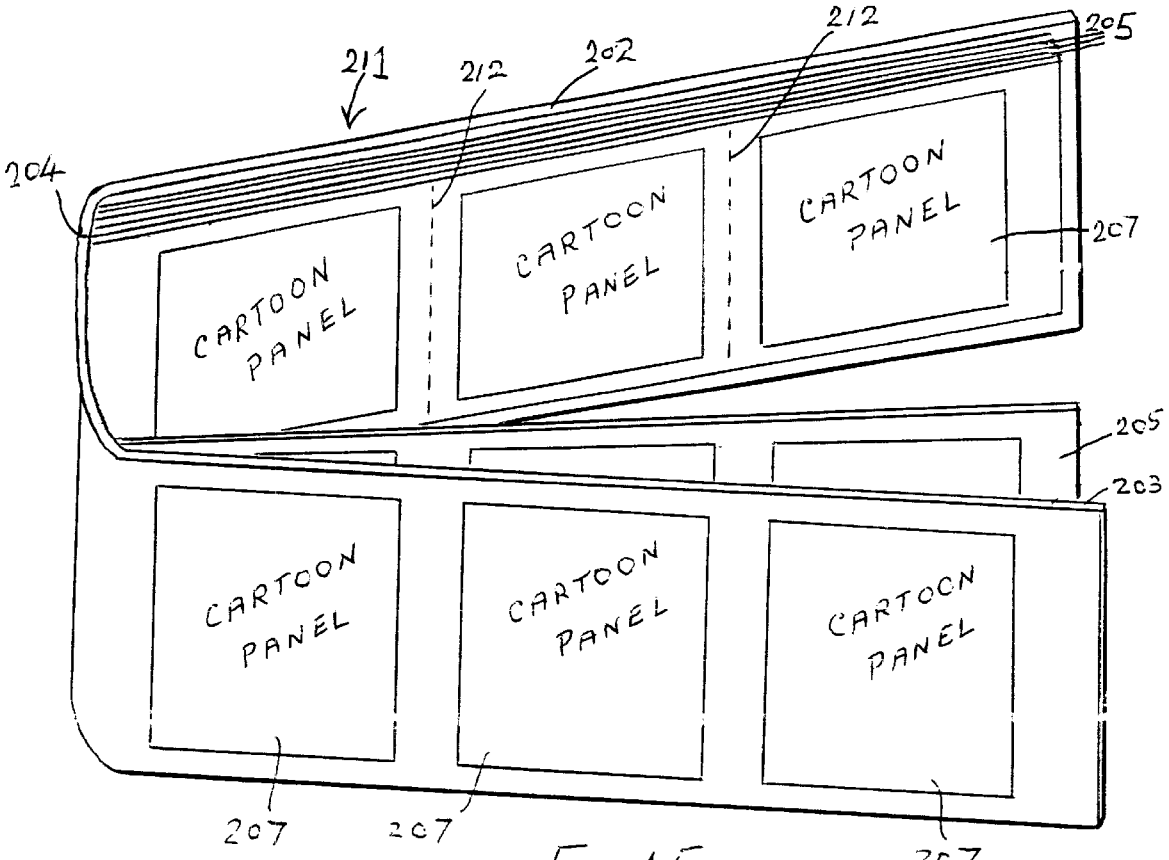
FIG. 15 is a perspective front elevation of an advertising and technical information booklet, shown in partially opened condition to reveal internal pages.

Referring to FIG. 15 of the drawings, there is shown an advertising and technical information booklet, designated generally by the reference number 201, which is elongated in shape in that its width is about three times its height, for a purpose which will be apparent from the following description.

The booklet comprises a back cover 202 and a front cover 203 which, in this embodiment, are integrally connected by a binding portion 204 so as to form a continuous whole.

The back cover 202, the front 203, and the binding portion 204 are made of a stiffer, e.g. a heavier grade of sheet material, such as paper, for imparting general stiffness and rigidity to the booklet as a whole.

Secured between the back cover 202 and the front cover 203 are a plurality of pages 205 which are relatively thinner and of slightly less height and length than the covers, these pages 205 being secured to the binding portion 204 as by adhesive, either individually, or in another embodiment by securing the whole of the bundle of pages together by adhesive to form a block, and then securing the block by adhesive of mechanically, or both, to the inside face of the binding portion 204. In FIG. 15 the booklet is shown with the majority of the pages already removed, and only six pages remaining, for better illustration. The pages 205 are of relatively flimsier and more readily bendable material than the covers 202 and 203, and are of paper, or in another embodiment are of thin plastics sheeting.

The nature of the binding of the pages 205 to the binding portion 204 is made such that the pages can be readily detached from the bundle of pages, one or more at a time, without disturbing the connection of the remainder of the pages to the binding portion 204.

Figure 16:
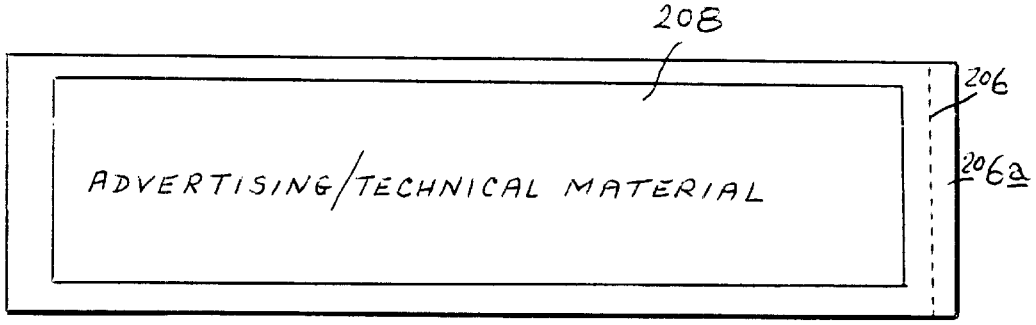
FIG. 16 is an elevation of the reverse face of one of a plurality of detachable internal pages of the booklet of FIG. 15.

In another embodiment, as seen in FIG. 16 of the drawings, the pages 205 are each perforated, or crimped, or reduced in thickness, or otherwise weakened along a line 206 so as to permit the page to be readily detached manually from the booklet leaving a stub 206*a* still attached to the binding portion 204.

On the forwardly presented face of the front cover 203, and of each of the pages 295, and of the back cover 202 there are applied, by any convenient known printing process, a plurality of panels 207 of cartoon-style illustration, say three in a number as illustrated, and these are intended to attract the attention of the person handing the booklet. For this purpose, the three panels 207 could illustrate, when taken serially from left to right, three stages of an amusing or instructive situation. In other embodiments more or less then three panels, such as 207, could be provided and the panels are, in a further embodiment, arranged in two or more rows arranged one above another.

Thus, for a person handling the booklet, the appearance of the booklet when closed catches the attention of that person before the booklet is handled, and if the booklet is then picked up and either opened page by page, or is "riffled", there will be a series of cartoon panels presented to view and, for example, telling a story.

In a further embodiment, the cartoon panels of the covers and of the pages, or at least some of the pages, form part of a continuous series.

On the rearwardly presented face of the front cover and of the back cover and each of the pages, there is provided, as by printing, some reading matter 208 (see FIG. 16) which is of a technical and/or advertising and/or promotional nature, for example to bring to the attention of the reader the nature of, and use of, an article or instrument or the like which is being promoted.

Figure 17:
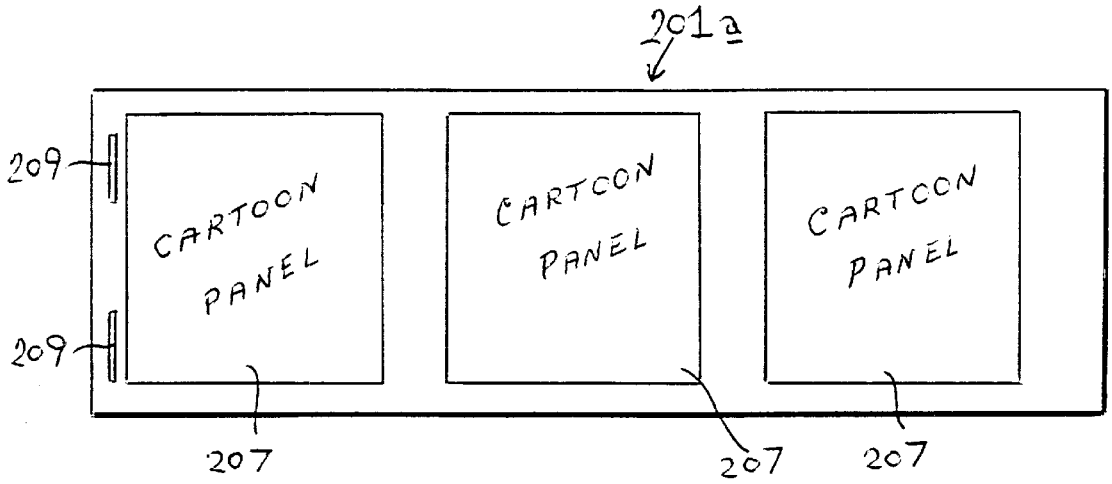
FIG. 17 is a front elevation of another embodiment of advertising and technical information booklet in which the front and back covers, and the pages there between, are secured by one or more staples, e.g. two as shown.

Referring now to FIG. 17 of the drawings, there is shown a front elevation of another embodiment of the bootlet 201*a* in which the front and back covers and the pages there between are secured by two metal or plastic staples 209.

Figure 18:
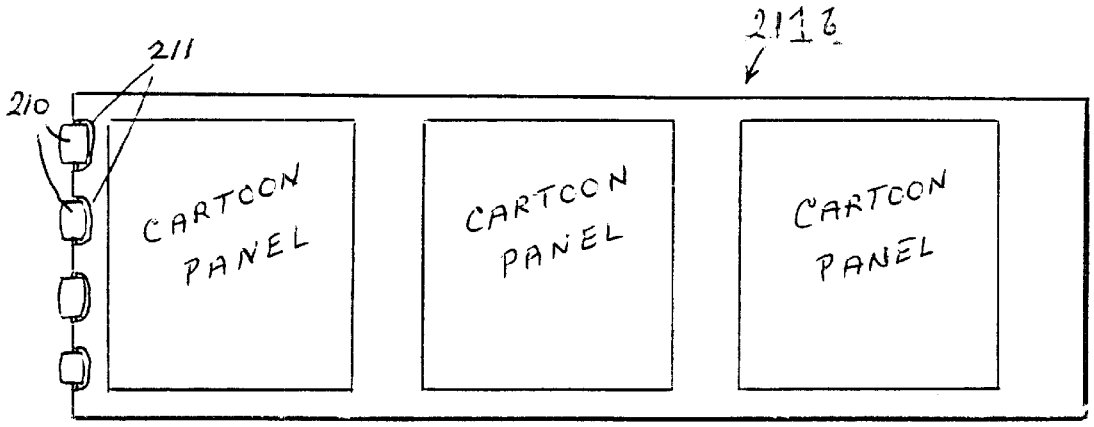
FIG. 18 is a front elevation of yet another embodiment of advertising and technical information booklet in which the front and back covers and the pages there between, are secured by loops of binding material passed through apertures in the covers and the pages.

Referring now to FIG. 18 of the drawings there is shown a front elevation of yet another embodiment of the booklet 201*b* in which the front and back covers and the pages there between are secured by rings or loops or a spiral 210 passed through apertures in the covers and pages thus enabling the front cover and the pages to be readily opened and to fall to hand in a flat condition.

A primary use of the booklet is that individual pages, or parts of pages, can be detached and, for example, pinned up on a notice board where the cartoon matter can attract the attention viewers, whereas the technical matter is then brought to the attention of the viewers, for example for promotional purposes.

The individual pages 205, in another embodiment, are made relatively thicker and stiffer, rather then being flimsy and bendable, so that they can be more readily handled, and if desired fixed to a support such as a notice board.

In a preferred embodiment, the individual pages are serially numbered, and by way of example there may be twenty-five or thirty such pages, or any desired number, which can be accommodated in practice between the covers and secured by binding.

In another embodiment, the individual panels of the pages have a perforation or other weakening between them, as shown at 212, to permit one or more of the panels to readily detached by hand, by tearing across their height dimension.

An amount of advertising and/or technical material for, for example a company name, a product name, a logo, mail or telephone numbers, or identification wording or numbering is in a further embodiment also provided on the cartoon-bearing face of the pages and/or of the covers.

Cartoon material is also provided, in a still further embodiment, on the inside face of the front cover. In a still further embodiment, the pages are prepared in such a manner that the cartoon material and the advertising/technical material are alternated on successive pages, i.e. one such page has cartoon material on its front face and advertising/technical material on its rear face, and the next adjacent page has advertising/technical material on its front face and cartoon material on its rear face.

I claim:

1. In a book comprising multiple bound pages of sheet material, each page having two long horizontal edges and two short vertical edges, all pages being detachably bound along one short edge to provide a book-like appearance for a pack of pages;

the improvement in which each page of said book is of stiff bendable paper and displays on a first face a series of at least three sequential story line illustrated unique cartoon panels of similar size and has a reverse second face displaying descriptive textual printed material;

said pages of said book being bound together along a short vertical edge to display cartoon panels on alternating faces of each page and to display printed descriptive text on the reverse side of each cartoon display;

each page of said book having a preformed line of weakness along the binding to allow the assembly and collection of cartoon panels in selected order and having between each individual panel a preformed line of weakness for folding or tearing.

* * * * *